United States Patent [19]

Zahn et al.

[11] 4,067,105

[45] Jan. 10, 1978

[54] METHOD OF MAKING AN INSULATED SPLICE AND AN INSULATED TERMINAL AND COMPOSITE SUPPLY STRIP THEREFOR

[75] Inventors: Irwin Zahn, New York, N.Y.; Wilhelm R. Meisinger, Verona, N.J.; Edward M. Fischer, New Gardens Hills, N.Y.

[73] Assignee: General Staple Co., Inc., New York, N.Y.

[21] Appl. No.: 711,604

[22] Filed: Aug. 4, 1976

Related U.S. Application Data

[60] Division of Ser. No. 537,532, Dec. 30, 1974, which is a continuation of Ser. No. 335,417, Feb. 23, 1973, abandoned.

[51] Int. Cl.[2] ..... H01R 43/04

[52] U.S. Cl. ..... 29/628; 29/630 F; 29/747; 29/748; 174/84 C; 174/117 A; 339/276 R; 339/276 SF

[58] Field of Search ..... 29/628, 630 A, 630 R, 29/203 D, 203 DT, 203 DS, 747, 748, 630 F; 174/84 C, 90, 94 R, 117 A; 339/276 R, 276 T, 276 SF

[56] References Cited

U.S. PATENT DOCUMENTS

| | | | |
|---|---|---|---|
| 2,338,524 | 1/1944 | McCabe | 29/630 A |
| 2,410,321 | 10/1946 | Watts | 174/84 C |
| 2,786,191 | 3/1957 | Broske | 339/276 T |
| 2,845,606 | 7/1958 | Fuller | 339/276 T |
| 2,855,581 | 10/1958 | Freedom | 29/630 A X |
| 3,009,197 | 11/1961 | Hahn | 29/630 A X |
| 3,510,829 | 5/1970 | Keller | 339/276 SF |
| 3,636,611 | 1/1972 | Rosenbaum | 29/203 D |

FOREIGN PATENT DOCUMENTS

| | | | |
|---|---|---|---|
| 198,739 | 6/1923 | United Kingdom | 174/117 A |

*Primary Examiner*—Victor A. DiPalma

*Attorney, Agent, or Firm*—Lerner, David, Littenberg & Samuel

[57] ABSTRACT

A method is disclosed for making an insulated splice or terminal, the method including the steps of adhering an elongated layer of non-conductive material to an elongated layer of electrically conductive material so as to form a composite supply strip; severing a predetermined length of said supply strip from the remaining supply of said strip; and crimping said length about the elements to be joined until said electrically conductive material is in electrical contact with the said elements and so that the non-conductive material forms an outer insulated layer enclosing said splice or at least a portion of said terminal. In a preferred method of the instant invention, a further step of causing the non-conductive material of the splice to "flow" is employed whereby a resultant sealed splice is produced which is impervious to moisture and other contaminants. Novel composite supply strips for use in the aforedescribed method are also disclosed as well as a novel die for use in an automatic splice producing machine which includes means for forming such splices from a continuous supply roll and optionally means for forming the composite supply strip.

25 Claims, 24 Drawing Figures

FIG.1
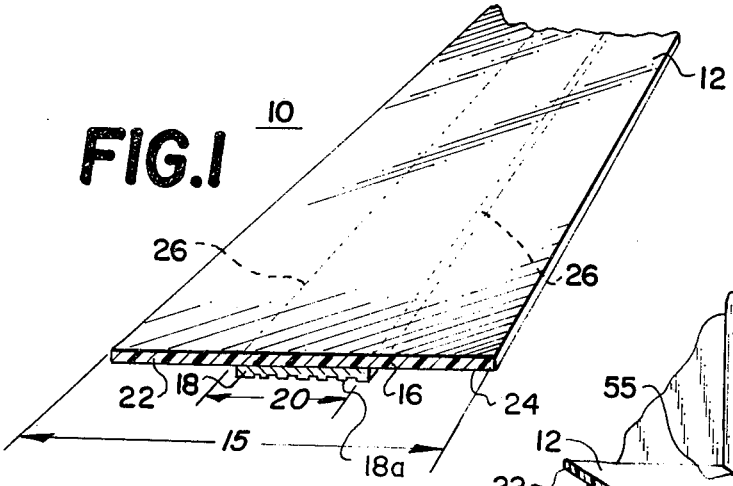
FIG.2
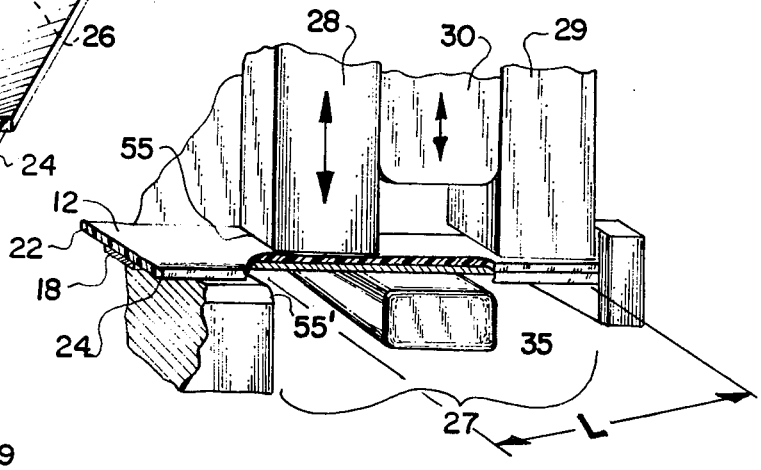
FIG.3
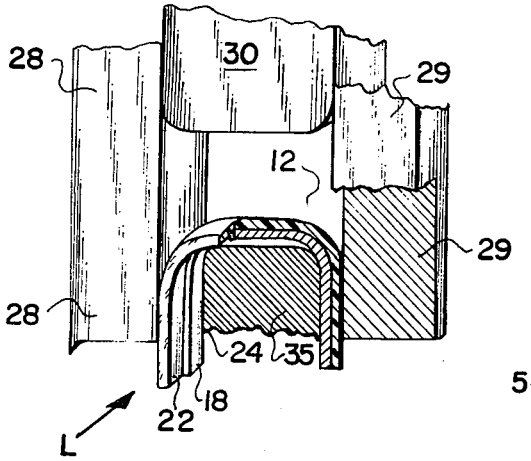
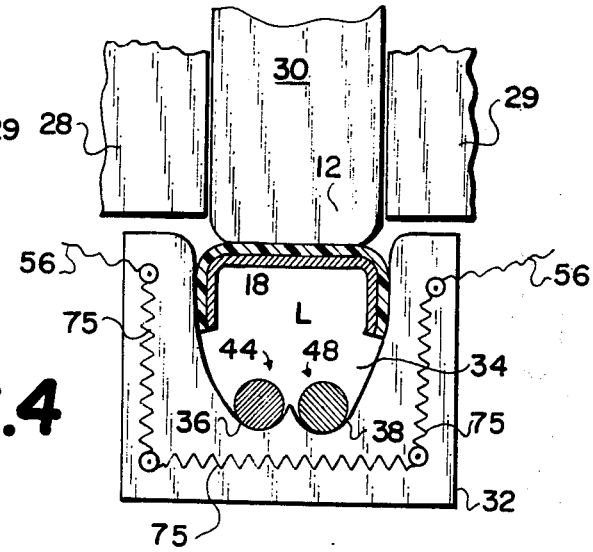
FIG.4
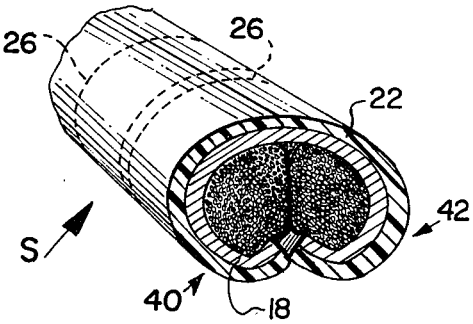
FIG.6
FIG.5
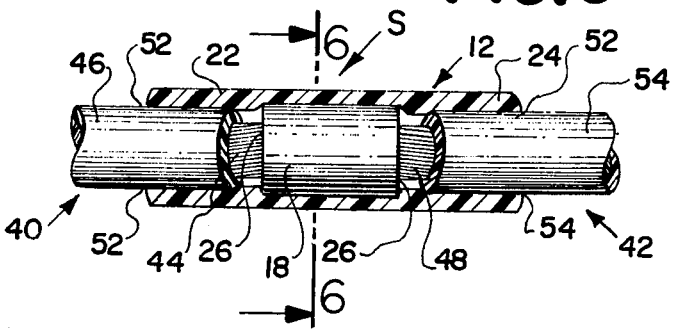

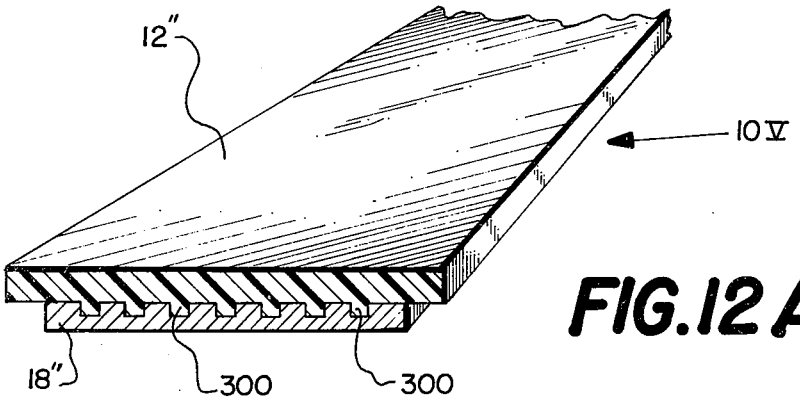
FIG. 12 A
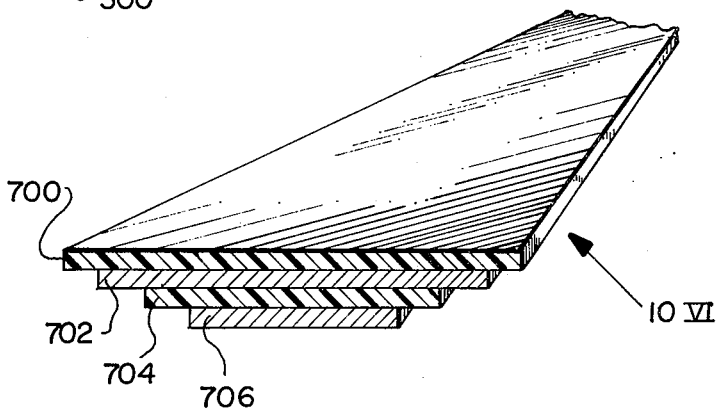
FIG. 8A
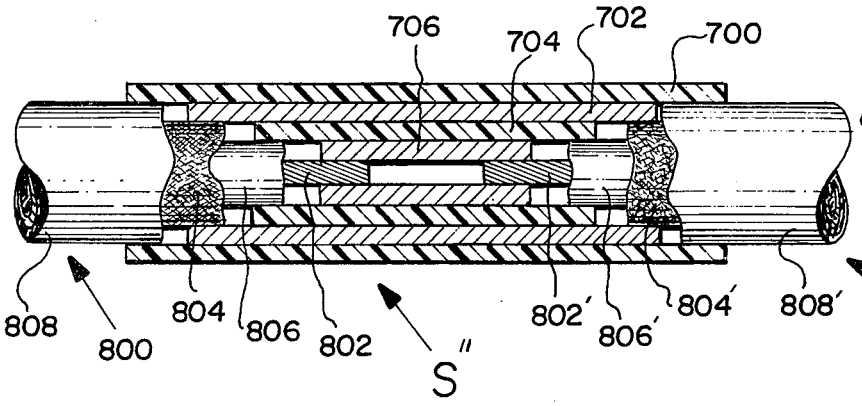
FIG. 8B
FIG. 9A
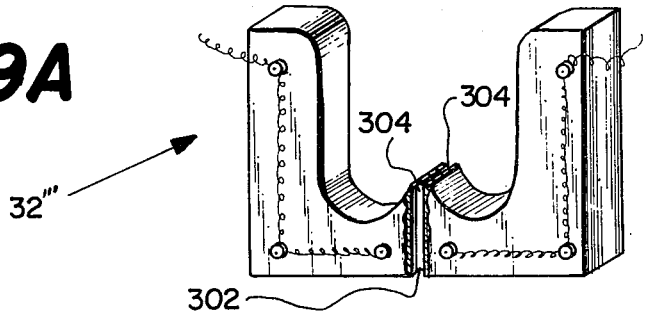

METHOD OF MAKING AN INSULATED SPLICE AND AN INSULATED TERMINAL AND COMPOSITE SUPPLY STRIP THEREFOR

This is a division Ser. No. 537,532 filed Dec. 30, 1974 which is a continuation of application Ser. No. 335,417 filed Feb. 23, 1973 now abandoned.

FIELD OF THE INVENTION

This invention relates to electrical connectors, more particularly to electrical connectors which may be automatically formed, driven and crimped by a machine supplied with a continuous supply roll, and even more particularly to a method of forming insulated electrical connectors and insulated terminals from a continuous supply roll and to an automatic splice producing machine which includes means for forming insulated electrical connectors.

BACKGROUND OF THE INVENTION

In the United States Pat. No. 3,636,611 issued Jan. 25, 1972 to Irving W. Rosenbaum entitled "Apparatus for Splicing Wires", and assigned to the assignee of the instant invention, there is disclosed a machine for producing a connector (also known as a splice) about a pair of wires which are to be electrically and mechanically joined. As is disclosed in the aforementioned patent, the apparatus thereof operates from a continuous supply of flat electrically conductive material (i.e. wire stock) and in one completely automatic cycle feeds, forms, drive and crimps the splice thereformed about the pair of wires to be joined. To this end, the apparatus of the aforementioned patent includes: means for feeding an appropriate length from the supply coil; means for severing said appropriate length; means for bending the cut-off length into an inverted U-shaped configuration about a temporarily positioned anvil; and means for driving the now appropriately shaped length into an appropriately configured generally U-shaped clinching die in which has been previously positioned the ends of the two wires to be joined by the splice thus formed.

As noted in U.S. Pat. No. 3,636,611 the apparatus thereof represents a significant improvement over the previous technique of splicing wires together by a process which required the previous manufacture of preformed connectors (much like a supply of common, preformed staples) and the employment of a separate machine for driving said preformed staples into a crimping die about the wires to be joined.

The aforedescribed apparatus has in fact materially simplified and reduced cost associated with producing a splice for mechanically and electrically joining a pair of electrical conductors. However, in many applications, it is desirable and indeed sometimes necessary that the splice established between the pair of conductors be electrically insulated and/or sealed so as to be impervious to moisture and other contaminants. Thus, it will be appreciated that in the typical utilization of the aforedescribed apparatus to join a pair of wires which include a bare portion from which the insulation has been stripped, the placement of an electrical splice about the bare portions of the wires will of course provide the desired electrical and mechanical connections but will leave the metallic splice thus formed, as well as regions of the bare portions of the two wires, exposed to the atmosphere.

In the same vein, U.S. Pat. No. 3,605,261 issued Sept. 20, 1971 to Irwin Zahn et al. entitled "Method and Apparatus for Making Terminals and for Attaching the Same to Conductors", and assigned to the assignee of the instant invention, discloses a machine for making a terminal and for attaching the terminal to a conductor. The apparatus disclosed in this patent operates from a continuous elongated strip or flat wire supply and in one automatic or semi-automatic cycle forms the terminal and clamps the terminal on the conductor. The apparatus disclosed includes means for feeding the elongated strip, means for forming the terminal from said strip including means for forming an aperture in first portions of said strip, means for severing second portions from the remainder of said strip, each severed second portion forming a blank, means for bending a portion of said blank into an approximate U-shape about an anvil, and means for driving the blank into a die and means for clamping said approximately U-shaped part of the bent blank on a conductor previously introduced into said die.

As in the case of the splicing operation described above, in many applications, it is desirable and indeed sometimes necessary that the portion of the terminal attached to the conductor be electrically insulated and/or sealed.

Until the present invention, attempts to employ the aforementioned apparatus of U.S. Pat. Nos. 3,636,611 and 3,605,261 or indeed any apparatus in such a manner as to produce an insulated splice or insulated terminal from a continuous supply roll have been unsuccessful.

SUMMARY OF THE INVENTION

In accordance with the instant invention, a composite supply strip has been developed for use in the formation of insulated splices and insulated terminals by means of apparatus similar to the type disclosed in the aforementioned U.S. Pat. No. 3,636,611 and U.S. Pat. No. 3,605,261. The composite supply strip hereof comprises an elongated layer of electrically non-conductive material having a first predetermined width; and an elongated layer of electrically conductive material adhered to the layer of non-conductive material with the layer of conductive material having a second predetermined width. Although the widths of the conductive and non-conductive layers may be the same, it is preferred that the width of the layer of conductive material is less than the first predetermined width of the non-conductive material. As will be described in greater detail, by employing such composite supply strip in a method of forming a splice similar to the method performed by the apparatus of the aforementioned Rosenbaum patent, a splice will be formed from a continuous supply roll that will not only mechanically and electrically join the stripped away bare portions of the pair of wires to be joined, but will also insulatingly provide a seal extending from the insulated portion of one of the wires to the insulated portion of the other wire. Furthermore, where such composite supply strip is employed in a method or forming a terminal and attaching the terminal to a conductor similar to the method performed by the apparatus of the aforementioned Zahn et al. patent, a terminal will be formed from a continuous supply roll that will not only terminate a conductor, but will also provide an insulated end for the conductor.

In an alternative method of the instant invention, the layer of non-conductive material forming a portion of the composite supply strip is a heat-fusible material chosen to soften at a predetermined temperature. In accordance with this method, a further step of heating the splice or terminal is performed to cause the non-conductive material to "flow" thereby achieving not only an insulated splice or terminal, but a sealed splice or terminal impervious to moisture and other contaminants as well.

In accordance with this aspect of the invention, the heating step can be performed in a number of different rays. Thus, in one embodiment of the instant invention, the aforemetnioned crimping or clamping die is heated about the softening point of the non-conductive material of the splice or terminal. Thus, the sealing is actually accomplished during the last step of the production and placement of the connector or terminal. In an alternative embodiment, the heat is applied to the connection or terminal during a separate subsequent operation outside of the confines of the crimping or clamping die. In yet another embodiment, the composite supply strip may be preheated to just below the softening point of the non-conductive material, with the heat generated during the bending and forming operation utilized to raise the temperature to the softening point of the non-conductive material. In another embodiment, the metallic connection (and the wires so joined) or conductor portion attached to the terminal may be heated by induction heating. Of course, any appropriate means of effecting the heating step may be utilized.

As a further feature of the instant invention, the composite supply strip may include an elongated layer of electrically non-conductive adhesive adhered to one or both of the longitudinal edge portions of the layer of non-conductive material which extend beyond the edges of the layer of conductive material.

In a further alternative embodiment of the instant invention, the electrically non-conductive layer forming a portion of the composite supply strip of the instant invention may include a stiffening element embedded therein. Thus, when the splice or terminal is bent and formed around the pair of conductors to be joined or conductor to be terminated, the stiffening element will help retain the shape of the splice or portion of the terminal attached to the conductor. In a similar vein, the conductive layer forming a portion of the composite supply strip may be T-shaped in cross-section so as to include a pair of oppositely directed wing portions which are embedded in the non-conductive layer of material. Such wing portions will also serve the function as stiffening elements.

In an another embodiment of the present invention, the electrically non-conductive layer forming a portion of the composite supply strip of the invention may be adhered to an extend around one or both of the longitudinal edge portions of the layer of conductive material. Further, the electrically non-conductive layer may even be adhered to a portion of the under surface of the conductive material.

In still another embodiment of the composite supply strip of the instant invention, the electrically non-conductive layer may be adhered to and extend over an upper surface of the conductive material as well as one longitudinal edge and a portion of the lower surface thereof. In this embodiment, the conductive material may be thicker in cross-section at the portion not covered by the electrically non-conductive material and thus will have an L-shaped cross-section as will be seen hereinafter.

In yet a further embodiment of the composite supply strip of the present invention, the conductive material may be divided into sections spaced from one another and each section adhered to the layer of electrically non-conductive material.

The conductive material in any or all of the embodiments of the composite supply strip of the invention described herein may include serrations or be knurled on the surface to be placed in contact with the elements to be connected or joined. The serrations or knurls may be applied longitudinally and/or transversely on such surface to increase the surface area of the conductive material so as to provide greater electrical contact areas with the elements to be joined as well as to provide cutting edges and thus additional bonding areas which increase the strength of the contact area with the elements to be joined.

In addition, as will be seen hereinafter, the surface of the conductive material in contact with the non-conductive material may be provided with serrations, knurls or perforations to enhance adherence of the non-conductive material to the conductive material.

Thus, it is an object of the instant invention to provide a method for forming an insulated splice or insulated terminal from a continuous supply roll.

Another object of the instant invention is to provide composite supply strips for use in the formation of insulated splices or insulated terminals.

Another object of the instant invention is to provide a method of producing an insulated splice from a continuous supply roll with apparatus of the type disclosed in U.S. Pat. No. 3,636,611.

Another object of the instant invention is to provide a method of producing an insulated terminal from a continuous supply roll with apparatus of the tupe disclosed in U.S. Pat. No. 3,605,261.

Still another object of the instant invention is to provide such an insulated splice or insulated terminal which will also be impervious to moisture and other contaminants.

Still another object of the instant invention is to provide a novel die structure for use in the method of the instant invention and with the composite supply strip of the instant invention.

Yet another object of the instant invention is to provide an automatic splice producing machine or a machine for forming terminals and attaching the terminals to conductors which includes means for forming the composite supply strip of the invention.

These and other objects of the instant invention will be apparent by referring to the following description and drawings.

BRIEF DESCRIPTION OF THE SEVERAL VIEWS OF THE DRAWING

FIGS. 1, 1A, 1B, 1C, 1D and 1E are perspective views of a portion of composite supply strips constructed in accordance with the instant invention.

FIG. 2 is a perspective view, partly in section, illustrating the manner in which a predetermined length of the composite strip of FIG. 1 is severed from the remaining portion thereof with the type of apparatus disclosed in the aforementioned U.S. Pat. No. 3,636,611.

FIG. 3 schematically illustrates the manner in which a severed length of the composite supply strip is bent into the desired inverted U-shape with apparatus of the type disclosed in U.S. Pat. No. 3,636,611.

FIG. 4 illustrates in schematic form, the manner in which the appropriately shaped length of supply strip is driven into a crimping anvil similar to the type disclosed in U.S. Pat. No. 3,636,611 but constructed in accordance with the instant invention.

FIG. 5 is a sectional view of an insulated splice constructed in accordance with the instant invention in situ about a pair of conductors joined thereby.

FIG. 6 is a perspective view of an insulated splice taken along lines 6—6 of FIG. 5 which has been produced in accordance with the instant invention.

FIG. 8A is a sectional view of another embodiment of the composite supply strip of the invention.

FIG. 8B is a sectional view of an insulated splice formed from the composite supply strip of FIG. 8A and shown in situ about a pair of coaxial cables joined thereby.

FIG. 9A is a view of another embodiment of the crimping die of the invention.

FIGS. 10, 11, 12 and 12A are perspective views of further alternate embodiments of a supply strip constructed in accordance with the present invention.

DESCRIPTION OF THE PREFERRED EMBODIMENTS

Figure 1A:
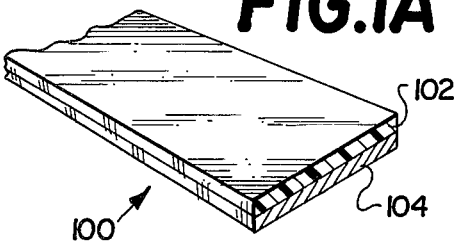

Turning to FIG. 1, there is shown a composite supply strip 10 constructed in accordance with the instant invention and intended for use in a method performed for example by the apparatus disclosed in U.S. Pat. No. 3,636,611 or U.S. Pat. No. 3,605,261, the contents of which are incorporated herein by specific reference thereto. The supply strip 10 includes an elongated layer 12 of electrically non-conductive material having a first predetermined width designated by the dimension 15. Although the only essential characteristic of the layer 12 is that it comprises an electrically non-conductive material capable of being deformed into a predesired shape, for reasons to be further described, it is preferred that the material comprising the layer 12 be heat fusible (i.e. it can be softened and caused to flow at a predetermined softening temperature). Thus, within the contemplation of the present invention are heat fusible plastic films such as polyamide (nylon tape), polyester, polyolefins, such as polyethylene, polyvinychloride, other thermoplastic elastomers such as urethanes, or copolymers of any of the foreging which has the desired characteristics of being fused or caused to flow when a predetermined temperature has been reached. The non-conductive layer 12 may also be an expandable plastic, such as polyethylene or polyvinylchloride containing a volatile blowing agent such as azodicarbonamide. Or the expandable non-conductor may be a self-expanding material such as a thermosetting polyurethane. In accordance with the invention, the material comprising the layer 12 may also be head shrinkable as in the case of irradiated polyethylene. Additionally, any of the foregong material may be provided, if desired, with glass cloth reinforcement therein, or other known means for reinforcing the material by adding elements which change or enhance physical strength.

Adhered to one surface 16 (the undersurface in FIG. 1) of the layer 12 is an elongated layer 18 of electrically conductive material. The surface 18*a* of layer 18 is serrated or knurled as shown to increase electrical and physical or bonding contact area with the elements to be joined. Although the serrations and/or knurls are not shown in the supply strips of the invention illustrated in the remaining Figures, it is preferred that the surface of the conductive layer 18 in contact with the elements to be joined include serrations or knurls or perforations for the above reasons.

Any suitable electrically conductive material which can be deformed may be employed and such materials as brass, aluminum, tin, copper, solder alloys, such as tin-lead solders, other commercially available alloys, etc. are selected depending on the particular mechanical and conductive characteristic desired for the splice ultimately to be produced in accordance with the invention. Alternatively, the conductive layer 18 may be a composite of solder and brass or if desired solder alone. As will be described below, a solder layer 18 (or a composite solder and brass layer 18) is employed when it is desired to cause not only the insulated layer 12 but the conductive portion 18 to "flow" with the application of heat thereto.

As illustrated by the dimension 20, the conductive layer 18 has a second predetermined width which is less than the width 15 of the non-conductive layer 12. As a result, longitudinal edge portions 22, 24 of the layer of non-conductive material 12 extend beyond the longitudinal edges 26 of the conductive layer 18. The function of these longitudinally extending edge portions 22, 24 will be described below.

FIGS. 1A through 1E illustrate alternative embodiments of a composite supply strip constructed in accordance with the invention which may be employed for us in a method performed, for example, by the apparatus disclosed in U.S. Pat. Nos. 3,636,611 and 3,605,261. In FIG. 1A, the numeral 100 generally refers to a supply strip which includes a non-conductive layer 102 and a conductive layer 104, each layer being of approximately the same width, the two layers being bonded or adhered to each other.

Figure 1B:
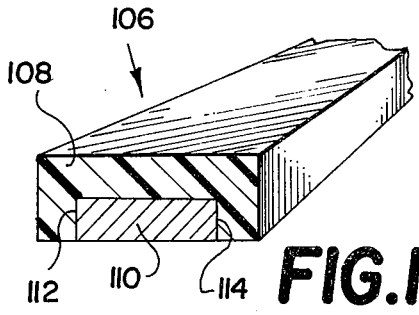

In FIG. 1B, the supply strip 106 shown is similar to that shown in FIGS. 1 and 1B in that it includes a layer of non-conductive material 108 to which is adhered a layer 110 of conductive material. The composite strip differs from the strips of FIGS. 1 and 1A in that the non-conductive material is also adhered to the longitudinally extending edge portions 112 and 114 of conductive layer 110.

Figure 1C:
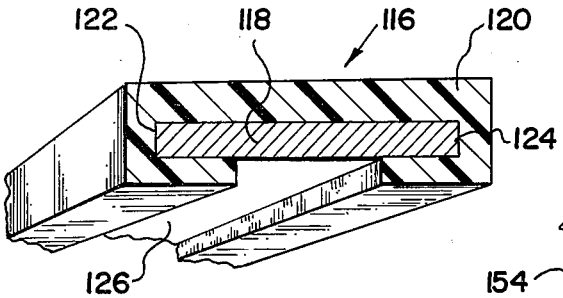

The composite strip 116 shown in FIG. 1C which includes: conductive layer 118 and non-conductive layer 120 is similar to that shown in FIG. 1B. The non-conductive layer 120 is adhered to longitudinal edges 122 and 124 of conductive layer 118. The strip 116 differs from that shown in FIG. 1B in that the non-conductive layer 120 is folded over at its ends and bent around a portion of the undersurface 126 of conductive layer 118 to partially encapsulate said undersurface 126.

Figure 1D:
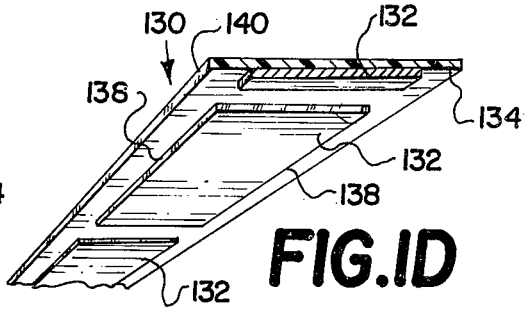

FIG. 1D shows a composite strip 130 in accordance with the invention wherein discontinuous pieces or sections of layers of conductive material 132 are adhered to non-conductive layer 134. In the FIG. 1D embodiment, all longitudinal edges 138 of the conductive material are recessed from the longitudinal edges 140 of the non-conductive layer 134. However, it will be understood that the pieces of conductive material may be of the same width as the non-conductive layer as in FIG. 1A.

Figure 1E:
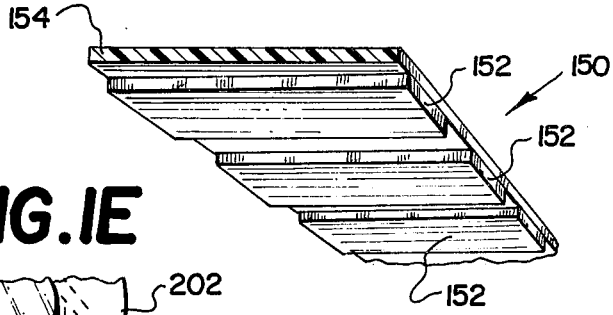

FIG. 1E illustrates a composite strip 150 which includes a layer of discontinuous conductive pieces 152 adhered to non-conductive layer 154. As shown, conductive pieces 152 are in side-by-side parallel relationship to each other. The width of the conductive pieces are of the same width as the non-conductive layer 154. However, it will be understood that the conductive pieces may have a width smaller than the width of the non-conductive layer 154.

The conductive layer 18 may be adhered to the non-conductive layer 12 by any suitable method. Techniques presently available are heat and pressure bonding, solventbonding, adhesive bonding or indeed any method which will have the end result of adhering layer 18 to layer 12.

In one embodiment of the invention, the non-conductive layer 12 is bonded to the conductive layer 18 by adhesive bonding. Contact and pressure-sensitive adhesives can also be applied as a layer on either or both of the conductive layer 18 and non-conductive layer 12. Layer 18 and layer 12 including adhesive interposed between the two layers are pressed together such as in the nip between two rollers to bond the layers together. The contact or pressure sensitive adhesive employed herein can be any conventional pressure-sensitive adhesive such as those based on natural rubber latex or synthetic latices based on styrene-butadiene rubber including conventional additives such as tackifiers, plasticizers and the like.

The contact adhesive may also take the form of a separate tape coated on both sides with any conventional pressure-sensitive adhesive as described above. The tape can be applied to one of layers 18 or 12 and the other layer can then be disposed on the tape to form the composite of the invention.

Another adhesive or bonding system suitable for use herein is the drying-type adhesive which can be applied to either or both of the layers 18 and 12 by wipe, spray, brush or roller applicator. Examples of such drying-type adhesives are adhesive emulsions generally based on polyvinyl acetate (water thinned), adhesive latices which are synthetic rubber based (water thinned) and adhesive lacquers based on nitrocellulose polyvinyl acetate, styrene-butadiene rubber, nitrile rubber, and neoprene (solvent thinned) and polyacrylates and polyurethanes (solvent thinned).

The adhesive may also be of the reactive type, that is those that solidify by the chemical reaction of two components; examples of reactive-type adhesives are polyurethanes, polysulfides, epoxies, and various polyesters known in the art.

Hot melt adhesives may also be employed, that is those adhesive applied from a melt thereof and which solidify and bond by change of state. Such hot melt adhesives include polyethylene-vinyl acetate copolymers, polyamides, and thermoplastic polyurethanes.

The bonding of the layers 18 and 12 may also be effected through the use of a solvent activator, that is a material which dissolves the surface of the non-conductive layer 12 making it act as a self-adhesive which upon solidifying bonds the conductive layer 18 thereto. Examples of suitable solvent activators include methyl ethyl ketone on nitrocellulose, tetrahydrofuran or dimethyl formamide on thermoplastic polyurethane, and methylene chloride on polyvinyl chloride.

Bonding of the layers 18 and 12 can also be effected by thermal bonding whereby the surface of a thermoplastic non-conductive tape (or the conductive layer 18) is heated to the softening point of the non-conductive layer 12 and the two layers pressed together and cooled. For example, where the non-conductive tape is a thermoplastic material such as polypropylene, the conductive layer 18 or the tape may be heated by contact or radiant heating or by frictional heating. Furthermore, where a nylon tape is employedultrasonic bonding of the layers 18 and 12 by means of the nylon tape may be effected. In addition, the thermal bonding employing the thermoplastic tape to bond the layers 18 and 12 may be effected by resistance or induction heating of the conductor.

A combination-double layer of non-conductive material may also be employed such as an outer Mylar layer and an inner layer of a polyolefin which serves as an adhesive for bonding the Mylar layer to the conductive layer and may, for example, be sprayed on to the inner surface of the Mylar layer.

The non-conductive layer 12 may also be bonded or secured to the conductive layer 18 by mechanical attachment, such as by snap fits, protrusions of the non-conductor extending through holes in the conductor and then pressure or heat expanded on the reverse side, that is similar to riveting.

The composite layers 12 and 18 may also be formed by spraying or vapor depositing a layer of conductive material onto the non-conductive layer 12 employing conventional metallizing technique. This technique is particularly applicable to the preparation of composite supply strips wherein discontinuous pieces of conductive material are deposited to form a strip, for example, as shown in figures 1D and 1E. Additionally, the composite strips may be formed by known extrusion techniques.

Turning to FIGS. 2 through 6, there is illustrated the manner in which an insulated splice is formed from the composite supply strip 10 of FIG. 1 (although any of the composite supply strips shown in the other Figures may be employed) in a method similar to the method performed by the apparatus disclosed in the aforementioned U.S. Pat. No. 3,636,611 which has been incorporated herein by specific reference thereto. In fact, to facilitate description, some of the reference numerals, namely 28, 29, 30, 35, and 55, employed herein were similarly employed in the aforementioned U.S. patent to designate corrresponding elements.

Thus, by feeding means of the type disclosed in the aforementioned U.S. patent, one end of the continuous supply strip 10 is advanced into a channelway 27 so as to come to rest above a temporarily positioned anvil 35 positioned beneath bending bars 28 and 29 (which travel together) and a narrow elongated driving ram 30 which travels in a path of movement between the bending bars 28, 29.

As explained in greater detail in the aforementioned U.S. patent, the sequence of operation is such that the bending bars 28, 29 first travel downwardly to sever (by means of shearing edges 55, 55') a predetermined length L of the composite supply strip 10 from the remaining supply thereof. Thereafter, continued downward movement of the bending bars 28, 29 will bend the length L about the anvil 35 to form the predesired inverted U-shape illustrated in FIG. 3 of the drawings hereof. It is important to appreciate and especially from a consideration of FIG. 2 with FIG. 3, that after severing the length L, the longitudinally extending edge portions 22 and 24 of the non-conductive layer 12 still extend from opposite sides of the conductive layer 18.

Continuing, and considering FIGS. 5 and 6, once the bending bars 28 and 29 have bent the length L into the appropriate shape, the driving ram 30 descends between the bars 28 and 29 and drives the length L into a crimping die 32 similar to the crimping die 14 described in the aforementioned U.S. Pat. No. 3,636,611 (but modified in accordance with the instant invention). It will be appreciated, and as is described in the aforementioned U.S. patent that as the ram descends, the anvil 35 is pivoted out of the path of travel of the length L of composite supply strip 10 which has been severed and bent in the aforedescribed manner.

As described in the aforementioned U.S. patent, the die 32 includes a generally U-shape receptacle 34 having a pair of depressions 36 and 38 for the reception of the wires 40 and 42 which are to be joined by the splices formed in the method of the instant invention.

Thus, considering FIG. 4 with FIG. 6, it will be appreciated that as the ram 30 descends, driving the length L into the receptacle 34 of the crimping die 32, the sides of the generally U-shaped segment will be driven under, up, and around the bare conductors 44 and 48 so as to define the ultimate splice S shown in FIG. 6.

As noted previously, the novel composite supply strip 10 as well as the aforedescribed method of employing same in a machine of the type described in U.S. Pat. No. 3,636,611 makes possible the formation of not only a mechanical and electrical connection between a pair of wires but also the insulation of such a splice thus formed. Thus, with respect to FIG. 6, a cross-sectional view of the splice S shown in FIG. 5, it will be appreciated that in a typical application, the wire 40 includes a bare, stripped away conductive portion 44 as well as the remaining insulated portion 46 thereof. In like fashion, the wire 42 would include the bare, stripped away portion 48 and the remaining insulated portion 50. In accordance with the instant invention, when the splice S is formed about the wires 40 and 42 to be joined, the metallic conductive portion 18 will securely and electrically connect the bare portions 44 and 48 while at the same time the longitudinally extending edge portions 22 and 24 of the non-conductive portion 12 will extend from the insulated portion 46 of the wire 40 to the insulated portion 50 of the wire 42, thereby completely insulating the metallic portion 18 of the splice as well as the exposed portions of the bare conductors 44 and 48.

As noted previously, it is a feature of the instant invention that if desired, not only can an insulated splice be formed in the manner previously described, but the method hereof makes possible the formation of a sealed, moisture impervious, insulated splice. In practicing this aspect of the instant invention, the material comprising the layer 12 of non-conductive material is chosen from any one of the number of thermplastic resins mentioned previously which are heat fusible (i.e. flow induced by heat alone or heat and pressure). In accordance with the invention, the only further step required to produce a sealed, insulated splice is to heat the splice S above the softening temperature of the material so chosen such that the material comprising the layer 12 of FIG. 5 will flow into sealing engagement with the wires 40 and 42 especially at the joints identified by the reference numerals 52 and 54 in FIG. 5, thereby establishing a sealed, insulated splice impervious to moisture and other contaminants.

In accordance with the invention, the application of heat can be performed in a number of different methods. Thus, with reference to FIG. 4, heating coils 75 are positioned internally of the crimping die 32 and an electrical source (not shown) is applied by means of conductors 56 to heat the crimping die 32 to a temperature above the softening point of the material chosen for the layer 12 of the non-conductive material. In this manner, as the splice S is being formed in the crimping die 32, the non-conductive material 12 will be fused so as to sealingly adhere to the pair of conductors 44, 49 in a manner previously described.

In an alternative method of the instant invention, the composite supply strip 10 is initially preheated to a temperature just below the melting point of the material comprising the non-conductive layer 12. Thereafter, the additional heat generated during the bending and forming operation produces the necessary rise in temperature to cause the material 20 to flow into sealing engagement with the pair of joined wires 40 and 42.

In yet another embodiment of the method of the instant invention, induction heating is performed on the splice and wires until the softening temperature of the material comprising the non-conductive layer 12 is reached thereby effectuating the desired seal.

In still another alternative embodiment of the instant invention, the step of applying heat to the splice is actually performed as a separate operation after the splice and the wires joined thereby have been removed from the crimping die 32. In this manner, the desired sealing can be accomplished at any time, at any place, and selectively by only those users who feel that moisture proof sealing is necessary. It will be appreciated that in the event a heat shrinkable thermoplastic or expandable resin is employed for the material 12, then during the application of heat, the material 20 will shrink into a tighter, more secure splice.

Where the composite supply strip of FIG. 1B is employed to form a splice, the splice will not include any exposed areas of conductive material. Furthermore, it will be understood that where the composite supply strips of FIGS. 1D and 1E are employed in forming a splice, the strips will preferably be severed along the non-conductive layer between the separate pieces of conductive material.

Figure 7:
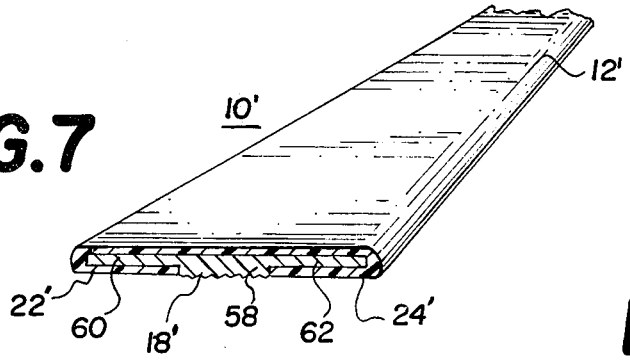
FIGS. 7 and 7A are perspective views of alternative embodiments of a supply strip constructed in accordance with the features of the instant invention.
Figure 8:
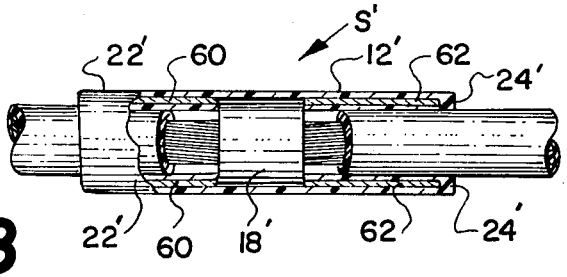
FIG. 8 is a sectional view of an insulated splice formed from the composite supply strip of FIG. 7 and shown in situ about a pair of conductors joined thereby.

Turning to FIG. 7, there is shown an alternative embodiment of a composite supply strip 10′ constructed in accordance with the instant invention. Like the composite strip 10 of FIG. 1, the strip 10′ includes a non-conductive layer 12′ as well as a conductive layer of material 18′. However, in the embodiment of FIG. 7, the conductive layer 18′ is generally T-shaped in cross-section and as such includes a trunk portion 58 and a pair of wings 60 and 62 extending in opposite directions therefrom. As seen in FIG. 7, the longitudinally extending edge portions 22′ and 24′ of the layer 12′ are folded over and bent around the wings 60 and 62 so as to encapsulate same. In this manner, when a splice S′ of FIG. 8 is formed from the supply strip 10′ of FIG. 7 in the manner described with respect to FIGS. 2 through 6, the resultant splice S′ will necessarily include stiffening means in the form of the wings 60 and 62 for adding mechanical integrity to the splice S′ and for preventing the splice from opening.

Figure 7A:
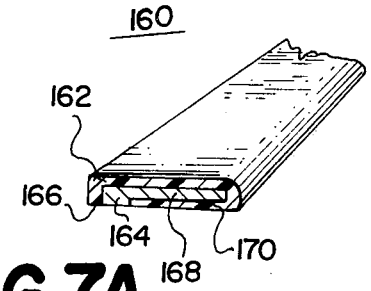

In FIGS. 7A, there is shown another alternative embodiment of a composite supply strip represented generally by the numeral 160. This embodiment, as in the previously described embodiments, includes a non-conductive layer 162 adhered to a conductive layer 164. The conductive layer 164 is generally L-shaped in cross-section and as such includes a short leg portion 166 and a long leg portion 168. As shown in FIG. 7A, the longitudinally extending edge portion 170 of the non-conductive layer 162 is folded over and bent around the leg long portion 168 so as to encapsulate the same.

Figure 10:
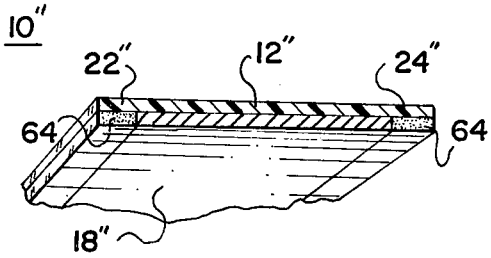

In FIG. 10, there is illustrated still another alternative embodiment of a composite supply strip 10'' constructed in accordance with the instant invention. The supply strip 10' is similar to the supply strip 10 in that it includes a layer 12'' of non-conductive material to which is adhered a layer 18'' of electrically conductive material. The composite strip 10'' differs from the strip of FIG. 1 in that adhered to the longitudinally extending edge portions 22'' and 24'' are layers 64 of electrically non-conductive fusible, flowable adhesive material such as polyvinyl acetate, polyamide, polyethylene, thermoplastic polyurethane and the like. Thus, when the composite supply strip 10'' is employed to form an insulated splice in the manner illustrated with respect to FIGS. 2 through 6, the adhesive layers 64, especially if heated, will further enhance the integrity of the splice. The layers 64 may also take the form of solder strips, such as tin-lead solder.

Figure 12:
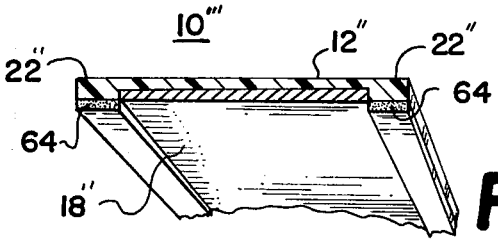

In one embodiment of the supply strip 10'' of FIG. 10 and/or the supply strip 10''' of FIG. 12, the electrical conductive material 18'' can comprise a solder strip, such as a tin-lead solder. The layer 12'' of non-conductive material can comprise a heat shrinkable plastic such as irradiated polyvinyl chloride, Teflon FEP (trademark of Dupont) or various olefin polymers; the heat of the solder layer will cause such heat shrinkable plastic to contract around the wires to be joined.

It will be understood that in any of the supply strips of the invention described herein that the conductive layer thereof may be a layer of solder.

Figure 11:
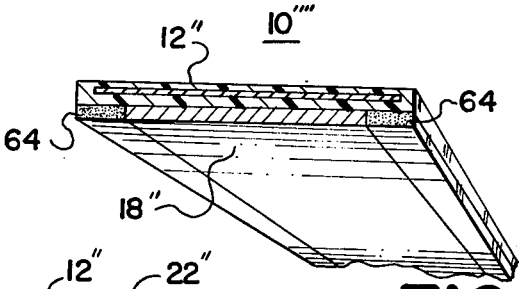

The composite supply strip 10''' of FIG. 12 is identical with the composite supply strip 10'' of FIG. 10 with the exception that the electrically conductive layer 18'' is partially embedded with the non-conductive layer 12''. The composite supply strip 10'''' shown in FIG. 11 is similar to the composite supply strip 10'' illustrated in FIG. 10 with the exception that an elongated flat stiffening element 66 is encapsulated within the non-conductive layer of material 12'' to add mechanical integrity to the splice thus formed.

Turning to FIG. 8A, there is shown an alternative embodiment of a composite supply strip 10$^{VI}$ constructed in accordance with the instant invention. The strip 10$^{VI}$ includes a non-conductive layer 700 adhered to a conductive layer 702, which in turn is adhered to a non-conductive layer 704, which in turn is adhered to a conductive layer 706. In effect, the strip 10$^{VI}$ comprises two plies of composite supply strip as shown in FIG. 1, one on top of the other, the conductive layer of one ply being bonded to the non-conductive layer of the second ply. The composite supply strip 10$^{VI}$ is particularly useful in connecting two coaxial cables to each other as described below.

In FIG. 8B, there is shown a splice S'' formed from the supply strip 10$^{VI}$ of FIG. 8A joining a pair of coaxial cables 800 and 800'. Coaxial cables 800 and 800' include an inner conductor 802 and 802', respectively, the ends of which have been stripped bare of insulation, outer conductor 804 and 804', respectively, the end of which are stripped bare of insulation, and separated from inner conductors 802 and 802' by insulating layer 806 and 806', respectively. The outer conductor 804 and 804' includes insulating layer 808 and 808', respectively. The splice S'' of FIG. 8B is formed from the supply strip 10$^{VI}$ of FIG. 8A in a manner similar to that described with respect to FIGS. 2 through 6.

In one of the preferred embodiments of the supply strip of the invention, the surface of the electrically conductive layer contiguous to the non-conductive layer is perforated or serrated. Such an embodiment is shown in FIG. 12A. In FIG. 12A, supply strip 10$^{V}$ is shown as including layer 12'' of non-conductive material to which is adhered layer 18'' of electrically conductive material. Layer 18'' includes perforations or serrations 300. In forming the supply strip 10$^{v}$, a portion of the layer 12'' of non-conductive material flows into the performations or serrations 300 of layer 18'' to tightly bond the layers 12'' and 18'' to each other.

It will be understood that in each of the supply strips of the invention described herein the surface of the layer of the electrically conductive material to be employed next to the layer of electrically non-conductive material can be perforated or serrated to enhance adherence of the two layers to each other.

Figure 9:
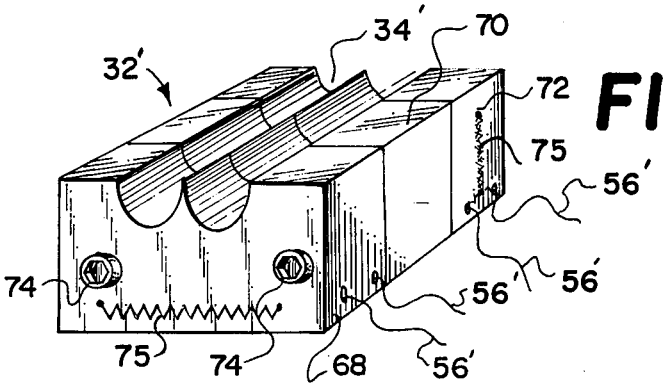
FIG. 9 is a perspective view of an improved crimping die constructed in accordance with the teachings of the instant invention.

Turning to FIG. 9, there is shown a crimping die 32' constructed in accordance with an alternative embodiment of the instant invention. As can be seen in FIG. 9, the crimping die 32' comprises a plurality of segments 68, 70, and 72 which are similar in appearance and when aligned and secured to one another by bolts 74 will produce the shape of the overall die desired. In accordance with this aspect of the invention, however, the central segment 70 may be case hardened or heat treated whereas the outside segments 68 and 72 would not be so treated thereby substantially reducing their cost as compared to the central segment 70. In accordance with this feature, the inventors are able to employ the softer segments 68 and 72 because, as will be appreciated from a consideration of FIG. 4 and FIG. 6, the greater mechanical impact must be applied to the central region of the length L of severed composite strip 10 where the metallic conductive layer is located, and accordingly only the center segment 70 of the crimping die 32 of FIG. 9 need be of a hardened material.

As can also be appreciated from a consideration of FIG. 6, the most critical areas with respect to the effecting of a sealed, insulated splice are at the external extremities of the non-conductive portion 12 of the splice (i.e. designated by the numerals 52 and 54 in FIG. 6). In accordance with a further feature of the invention as shown in FIG. 9 hereof, the heating coils 75 of FIG. 9 need only be located in the outside segments 68 and 72.

The crimping die 32 shown in FIG. 4, the crimping die 32' shown in FIG. 9 or any other crimping die employed in accordance with the invention can be fashioned to include means for inserting a non-conductive material, such as a plastic material as described herein, into the die cavity between the wires positioned therein to insure that the completed splice will be properly insulated. An example of a crimping die is shown in FIG. 9A and is referred to in general by the numeral 32'''. Crimping die 32''' includes means for introducing molten plastic material into the die cavity which may take the form of an injection mold cavity or channel 302 and a series of apertures 304 as shown. In addition, die 32''' includes heating coils 75.

In forming a splice employing the crimping die shown in FIG. 9A, after the splice is formed about a pair of elements, molten plastic is injected into channel 302 and through apertures 304 against the splice. The molten plastic will seep into any crevices or openings and against the metal parts of the splice to fully insulated the splice. The die and/or splice is then cooled before the completed splice is removed from the die cavity to ensure that the injected plastic has solidified.

Regardless of the crimping die employed, in carrying out the method of the invention, after the splice is formed, the crimping die can be cooled before the splice is removed from the die cavity in order to improve the cyclic rate of the splicing machine.

Figure 13:
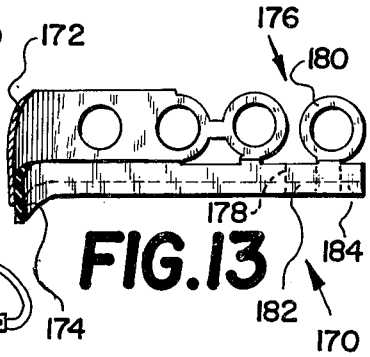
FIG. 13 is a perspective view of a supply strip constructed in accordance with the present invention for use in making insulated terminals for conductors.

Turning to FIG. 13, there is illustrated a composite supply strip generally referred to by the numeral 170 in accordance with the invention particularly suitable for use in making terminals to be attached to conductors in accordance with the method of and employing the apparatus described in U.S. Pat. No. 3,605,261. The strip as shown includes a conductive layer 172, a portion of which is adhered to non-conductive strip 174, as shown. The non-conductive strip is designed to insulate that portion of the conductive layer 172 which directly contacts the conductor. Thus, as per the method of and employing the apparatus of U.S. Pat. No. 3,605,261 a terminal 176 is formed and severed from the remainder of the strip by cutting across along the area indicated by broken lines 178. The severed blank 176 comprises an eyelet portion 180 and an approximately T-shaped portion which includes flanges 182 and 184 which will include non-conductive layer 174 and which are clamped about the conductor; the non-conductive layer 174 may overhang the flanges 182 and 184 as shown in FIG. 13.

Figure 14:
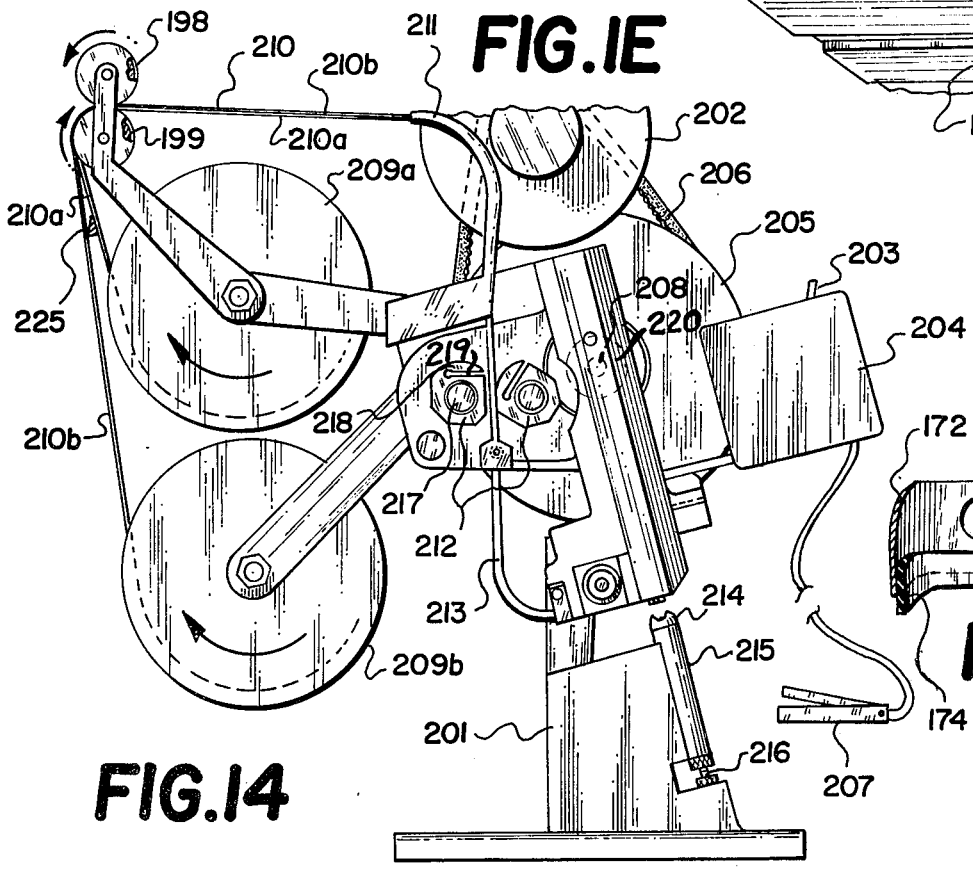
FIG. 14 illustrates a machine for forming the composite supply strip of the invention and for forming splices from said composite supply strip.

FIG. 14 illustrates a machine for producing splices similar to that shown in U.S. Pat. No. 3,636,611. However, the machine here illustrated, includes means for forming a composite supply strip from a separate supply of non-conductive material and a separate supply of conductive material. The machine shown in FIG. 14 includes a cast iron stand 201 which supports the operating elements of the illustrated apparatus and whose horizontal bottom face normally rests on a work bench or table, not itself shown. An electric motor 202 mounted atop the stand or frame 201 is controlled by a toggle switch 203 on a control box 204 mounted on the stand 201. A belt 206 connects the motor 202 with the input pulley of a single revolution clutch 205, not otherwise shown in detail, since it is a staple article of commerce (The Hilliard Corp., Elmyra, N.Y.). A pedal switch 207 is connected to the non-illustrated triggering solenoid of the clutch 205 through the control box 264 in a conventional manner to connect the output shaft 208 of the clutch to the pulley 205 for one revolution when the switch 207 is closed.

A reel 209a rotatable on the frame 201 carries a coiled strip or flat wire of conductive material 210a. A reel **209*b* also rotatable on the frame 201 carries a coiled strip of non-conductive material 210*b*. Nip rollers 198 and 199 are also attached to frame 201**, for example, as shown.

In operation, to form the composite supply strip of the invention, conductive material 210a and non-conductive material 210b are fed between the nip of rollers 198 and 199 and are thereby bonded together to form composite strip 210 for feeding to the machine in a manner to be further described. Alternatively, the non-conductive material may have been previously prepared as a tape-like material having an adhesive or tacky undersurface with the pressure of the nip rolls providing the necessary means to join the two layers. The nip rollers may also be heated rollers to effect bonding of the strips **210*a* and 210*b***.

The apparatus shown in FIG. 14 may also include means 225 for feeding an adhesive between the strips **210*a* and 210*b* before they are pressed together by the rollers 198, 199**.

In an alternative embodiment, a third reel carrying a tape having adhesive on each side thereof may also be affixed to the frame 201 to supply adhesive containing tape between the strips **210*a* and 210*b*** before the strips are pressed together. When such an adhesive-containing tape is employed, such tape will include a protective cover, such as a paper or carrier treated with a lubricious substance such as a silicone, for preventing the tape from adhering to itself while on the reel. The protective cover will be separated from the tape before the tape is fed into the splicing machine. An example of such a tape including a protective cover and means for stripping the protective cover therefrom is disclosed in U.S. Pat. No. 3,362,866 to Zahn.

The free end of the composite strip 210 formed is trained over an arcuate guide plate 211 and between two identical feed cams 212 into a metal tube 213 leading to the shaping and attaching station of the apparatus as described in U.S. Pat. No. 3,636,611. A fixed die plate 214 is the only tool of the apparatus fully visible. It is releasably mounted on a carrier 215 which may be adjusted on the frame 201 by means of a spindle 216 and associated nuts. The die plate 214 is exposed in all directions, and acess to the die cavity may be had at right angles to the plane of FIG. 14 by wires to be connected, there being ample space to accommodate even voluminous circuit elements which may be attached to the wires.

Each feed cam 212 is mounted on a shaft 217 and has an arcuate cam face 218 centered in the axis of the shaft 217 and having a length of about 90°. A slot 219 extending from one end of the cam face 218 approximately along the chord of the face into the body of each cam 212 gives some resiliency to the circularly arcuate cam portion whose radius is approximately equal to one-half of the spacing of the axes of the shaft 217.

The shafts 217 are connected with each other and with the clutch output shaft 208 by a gear train of which only a spur gear 220 on the shaft 208 is indicated in FIG. 14 and which turns the shafts 217 for one revolution in opposite directions when the switch 207 is closed. Setscrews, not themselves visible in the drawing, permit the cams 212 to be angularly adjusted on the shaft 217. The cams feed the strip 210 into the tube 213 as long as the cam faces 218 cooperate to grip the strip. The length of the cooperating portions, and the corresponding length of the strip 210 which is fed into the tube 212 during each revolution of the shaft 208 may thus be adjusted by setting the cams on the shafts 217.

The rest of the apparatus and its operation is described in detail in U.S. Pat. No. 3,636,611.

It will be appreciated that the means for pressing the layer of conductive material and layer of non-conductive material into engagement with one another (that is nip rollers 198, 199) may take the form of any other equivalent conventional structure (i.e. a pair of opposed plates, a plate and one roller, a fixed portion of the machine and one roller or one movable plate, etc.), the only requirement being that the two layers are pressed into engagement with one another.

It will also be appreciated that the reel arrangement including a supply reel for conductive material and a supply reel for non-conductive material, further including nip rollers, means for supplying adhesive or optionally means for supply adhesive tape may be incorporated into the apparatus for making terminals and attaching the terminals to conductors described in U.S. Pat. No. 3,605,261. Of course, in this embodiment, the reel for conductive material will be carrying the conductive material 172 and the reel for non-conductive matter will be carrying the non-conductive material 174, shown in FIG. 13.

In accordance with the invention, it will also be understood that the supply strip employed herein can supply individual splices for use with a machines adapted to operate with such a supply or even a hand tool. In this embodiment, it will, of course, not be necessary to sever a predetermined length of the supply strip from the remaining supply of such strip as where a continuous roll of such supply strip is employed. The individual splice need only be removed from the supply strip which, for example, can comprise a backing sheet or strip carrying an adhesive to adhere the individual splices thereto.

The insulated splices in accordance with the invention described above may be employed in any application where two elements are to be joined, regardless of whether an electrical connection is required. For example, such insulated splices can be employed to connect metal, plastic, wood, cord, rope, or other elements, close plastic bags, and is especially useful where the connector between such elements should be corrosion resistant, provide lubricity and be aesthetically appealling to the eye. An example of such an application for the insulated splice of the invention is in connecting a pair of nylon cords.

Although this invention has been described with respect to its preferred embodiments, it should be understood that many variations and modifications will now be obvious to those skilled in the art, and it is preferred, therefore, that the scope of the invention be limited, not by the specific disclosure herein, only by the appended claims.

What is claimed is:

1. A method of making insulated splices for joining elements; said method comprising:

providing an elongated layer of non-conductive material having a first predetermined width;

embedding a stiffening element within said layer of nonconductive material;

adhering said layer of non-conductive material to an elongated layer of electrically conductive material having a second predetermined width so as to form a composite supply strip; and crimping said composite supply strip about said elements until said electrically conductive material is in electrical contact with said elements.

2. The method of claim 1, wherein said composite supply strip comprises a continuous supply roll of said strip.

3. The method of claim 2 including the step of severing a predetermined length of said supply strip from the remaining supply of said strip.

4. The method of claim 1, wherein the second predetermined width is less than said first predetermined width and said step of crimping said length about said elements includes the steps of:

inserting each of said elements to be joined into opposite sides of a generally U-shaped receptacle provided in a die until the distance separating the junctures of the bare portion and the insulated portion of each of said elements is less than said first predetermined width of said non-conductive material;

bending said length into a generally U-shaped configuration; and driving said length into said U-shaped receptacle whereby said length will be crimped about said elements with said electrically conductive material in electrical contact with said elements and said non-conductive material forms an insulating layer enclosing the resulting connection.

5. The method of claim 4, wherein said elongated layer of electrically non-conductive material is a heat fusible material; and further including the step of heat sealing said electrically non-conductive material to said elements.

6. The method of claim 1, wherein said elongated layer of electrically non-conductive material is a heat fusible material; and further including the step of heat sealing said electrically non-conductive material to said elements.

7. The method of claim 5, wherein said step of heat sealing is effected by heating said die to at least the softening point of said heat fusible material.

8. The method of claim 4 including the step of cooling said die before removing the spliced elements from said die.

9. The method of claim 6, wherein said step of heat sealing comprises preheating said composite supply strip to a predetermined temperature just below the softening point of said non-conductive material; whereby the heat generated during said crimping step causes said softening point of said non-conductive material to be reached.

10. The method of claim 6, wherein said step of heat sealing comprises induction heating of said elements to heat said non-conductive material to its softening point.

11. The method of claim 5, wherein said step of heat sealing comprises removing said splice from said die; and thereafter heating said splice to the softening point of said non-conductive material.

12. The method of claim 6, wherein said non-conductive material is a thermoplastic synthetic resin.

13. The method of claim 12, wherein said layer of conductive material is brass.

14. The method of claim 6, wherein said layer of conductive material is brass.

15. The method of claim 1, wherein said elements comprise a pair of wires.

16. The method of claim 1, wherein said elements comprise a pair of coaxial cables.

17. The method of claim 1, wherein said layer of electrically non-conductive material is a heat fusible material having a first predetermined softening point; and said layer of conductive material has a second predetermined softening point; and further including the step of applying heat to said splice until said first and second predetermined softening points have been reached.

18. The method of claim 14, wherein said layer of conductive material is disposed intermediate the longitudinal edges of said layer of non-conductive material whereby first and second longitudinal edge portions of said layer of non-conductive material extend beyond the longitudinal edges of said layer of conductive material; and wherein further including a first elongated layer of electrically non-conductive adhesive adhered to said first longitudinal edge portion of said layer of non-conductive material; and further including the step of applying heat to said splice to melt said adhesive.

19. The method of claim 18, wherein said elongated layer of electrically non-conductive material is a heat fusible material having a predetermined softening point chosen to be reached during the application of heat to said splice.

20. The method of claim 1, wherein said layer of non-conductive material and said layer of conductive material are bonded to each other by an adhesive.

21. The method of claim 1, wherein said layer of conductive material and said layer of non-conductive material are bonded to each other by means of a tape having adhesive on both sides.

22. The method of claim 4 including the step of inserting molten plastic against the spliced elements positioned on said die.

23. The method of claim 1, wherein the surface of said layer of electrically conductive material not bonded to said layer of non-conductive material is serrated or knurled.

24. The method of claim 1, further including the step of forming said stiffening element of metal and totally embedding same within said layer of non-conductive material.

25. The method of claim 1, further including the step of forming said stiffening element and said layer of electrically conductive material in a generally T-shaped configuration which includes a central trunk portion and first and second wing portions extending from opposite sides of said trunk portion; said wing portions forming first and second stiffening elements; and folding over said first and second longitudinal edge portions of said layer of non-conductive material to enclose said first and second stiffening elements, respectively.

* * * * *

UNITED STATES PATENT AND TRADEMARK OFFICE

CERTIFICATE OF CORRECTION

PATENT NO. : 4,067,105

DATED : January 10, 1978

INVENTOR(S) : Irwin Zahn, Wilhelm R. Meisinger, and Edward M. Fischer

It is certified that error appears in the above-identified patent and that said Letters Patent are hereby corrected as shown below:

Column 3, line 8, the word "rays" should read -- ways --.
Column 4, line 32, the word "tupe" should read -- type --.
Column 5, line 56, the word "polyvinychloride" should read -- polyvinylchloride --.
Column 6, line 40, the word "us" should read -- use --.
Column 10, line 15, the numeral "49" should be -- 48 --.
Column 13, line 55, the numeral "264" should be -- 204 --.
Column 14, line 36, the word "acess" should read -- access --.

Signed and Sealed this

Ninth Day of May 1978

[SEAL]

Attest:

RUTH C. MASON
Attesting Officer

LUTRELLE F. PARKER
Acting Commissioner of Patents and Trademarks